US005382304A

United States Patent [19]

Cockayne et al.

[11] Patent Number: 5,382,304

[45] Date of Patent: Jan. 17, 1995

[54] FERROMAGNETIC MATERIALS

[75] Inventors: Brian Cockayne; William R. MacEwan, both of Malvern; Ivor R. Harris, Birmingham; Nigel A. Smith, Halesowen, all of England

[73] Assignee: The Secretary of State for Defence in Her Britannic Majesty's Government of the United Kingdom of Great Britain and Northern Ireland, London, England

[21] Appl. No.: 937,865

[22] PCT Filed: Mar. 5, 1991

[86] PCT No.: PCT/GB91/00346

§ 371 Date: Oct. 19, 1992

§ 102(e) Date: Oct. 19, 1992

[87] PCT Pub. No.: WO91/14271

PCT Pub. Date: Sep. 19, 1991

[30] Foreign Application Priority Data

Mar. 16, 1990 [GB] United Kingdom ..... 9006055
Mar. 16, 1990 [GB] United Kingdom ..... 9006056

[51] Int. Cl.[6] ..... C22C 38/00; H01F 1/04
[52] U.S. Cl. ..... 148/306; 420/8
[58] Field of Search ..... 148/306; 420/8, 77, 420/84, 103

[56] References Cited

U.S. PATENT DOCUMENTS 3,126,346 3/1964 Bither ..... 420/84
5,178,689 1/1993 Okamura et al. ..... 148/306
5,198,040 3/1993 Sawa et al. ..... 148/304

FOREIGN PATENT DOCUMENTS 0167118 1/1986 European Pat. Off. .
0258609 3/1988 European Pat. Off. .
0342921 11/1989 European Pat. Off. ..... 148/306
61-10209 1/1986 Japan .

OTHER PUBLICATIONS

Moffatt, W. G., et al., "*The Structure and Properties of Materials,*" vol. 1, pp. 46–47, 1964.
Journal of Applied Physics, vol. 55, No. 5, Mar. 1, 1984, M. Sagawa et al, "New Material for Permanent Magnets on a Base of Nd & Fe" pp. 2083–2089.
Journal of Applied Physics, vol. 38, No. 5, Mar. 1967, K. Strnat et al, "A Family of New Cobalt—Base Permanent Magnet Materials", pp. 1001—1002.
Journal of Crystal Growth, vol. 82, No. 3, Mar. 1987, Harris et al, "Phase Identification in Fe-Doped GaAs Single Crystals" pp. 450–458.

*Primary Examiner*—George Wyszomierski
*Attorney, Agent, or Firm*—Nixon & Vanderhye

[57] ABSTRACT

This invention provides a ferromagnetic material $Fe_{60}M_xN_y$ where M is at least one element selected from Al, Ga, In and Tl, N is at least one element selected from P, As, Sb and Bi, x has a range of $1 \leqq x \leqq 39$ and $x+y=40$ and excluding $Fe_{60}Ga_xAS_y$. A preferred ferromagnetic material is $Fe_{60}Ga_xAs_y$, preferably when x has a range of $3 \leqq x \leqq 37$, more preferably when x has a range of $20 \leqq x \leqq 37$, and even more preferably when x has a range of $30 \leqq x \leqq 37$. Typically, ferromagnetic materials of this type can be homogenised by annealing or melt spinning. Melt spun $Fe_{60}Ga_xAs_y$ can show Curie Temperatures ($T_c$) of about 470° C. and saturation magnestions of about 89 emu/g. Typically a ferromagentic material of the $Fe_{60}M_xN_y$ has a $B8_2$ type structure.

10 Claims, 1 Drawing Sheet

FERROMAGNETIC MATERIALS

SUMMARY OF THE INVENTION

This invention relates to ferromagnetic materials.

Ferromagnetic materials display a marked increase in magnetisation in an independently established magnetic field. The temperature at which ferromagnetism changes to paramagnetism is defined as one Curie Temperature, $T_c$.

Ferromagnetic materials may be used for a wide variety of applications such as motors, electromechanical transducers. Most of these applications use ferromagnets made from $SmCo_5$, (K Strnat et. al. J App Phys 38 p1OO1 1967), $Sm_2Co_{17}$, (W Ervens Goldschmidt Inform 2:17 NR, 48 P3 1979), $Nd_2Fe_{14}B$ (M Sagawa et. al. J App Phys 55 p2083 1984) and AlNiCo or ferrites (B D Cullity, Introduction to Magnetic Materials, Addison Wesley Publishing).

$Nd_2Fe_{14}B$ has one of the highest reported Curie Temperatures of rare earth-iron based alloys at 315° C. The inclusion of iron within an alloy is a well-established method of producing a ferromagnetic material. Iron has been used to dope GaAs in order to produce a material with ferromagnetic properties. I R Harris et. al. (J Crystal Growth 82 p450 1987) reported the growth of $Fe_3$-GaAs with a $T_c$ of about 100° C. More recently (International Patent Application Number PCT/GB 89/00381) it has been shown to be possible to obtain Curie Temperatures higher than those of $Nd_2Fe_{14}B$ with $M_3Ga_{2-x}As_x$ where $0.15 \leqq x \leqq 0.99$ and M may represent Fe is partially substituted by either manganese or cobalt. Where M=Fe, and x=0.15 then the material is characterised by Curie Temperature of about 310° C. Other ferromagnetic materials include that of GB 932,678, where the material has a tetragonal crystal structure and a transition metal composition component range of 61 to 75%, and an amorphous alloy ferromagnetic filter of the general formula $M_xN_yT_z$ where M is selected as at least one element from iron, nickel and cobalt, N is at least one metalloid element selected from phosphorous, boron. Carbon and silicon and T is at least one additional metal selected from molybdenum, chromium, tungsten, tantalum, niobium, vanadium, copper, manganese. zinc, antimony, tin, germanium, indium, zirconium and aluminum and x has a range of between 60 and 95%.

According to this invention a ferromagnetic material having a $B8_2$ type crystal structure comprises $Fe_{60}M_xN_y$ where M is at least one element from the group of Al, Ga, In and Tl, N is at least one element from the group of P, As, Sb and Bi, where $1 \leqq x \leqq 39$ and where $x+y=40$ and excluding $Fe_{60}Ga_xAs_y$. .

Preferably the ferromagnetic has a composition where M is gallium and N is antimony. This preferred material preferably has a preferred range of x of $3 \leqq x \leqq 37$, and even more preferred range of $20 \leqq x \leqq 37$ and most preferably a range of $30 \leqq x \leqq 37$.

The ferromagnetic material can be produced by methods including casting, which may be carried out in a Czochralski growth furnace. Where constituents of the ferromagnetic material are volatile at the high temperatures required for production, such as eg P and As, then an encapsulation layer is used to stop loss of the volatile constituents. A typical encapsulant is $B_2O_3$.

Where homogenisation of the phases within the material is required, then techniques such as annealing or melt spinning may be employed. A typical annealing program is one carried out at a temperature between 600° C. and 900° C. for a time length of between 7 and 21 days.

BRIEF DESCRIPTION OF THE DRAWINGS

This invention will now be described by way of example only, with reference to the accompanying diagram.

DESCRIPTION OF THE PREFERRED EMBODIMENTS

Figure 1:
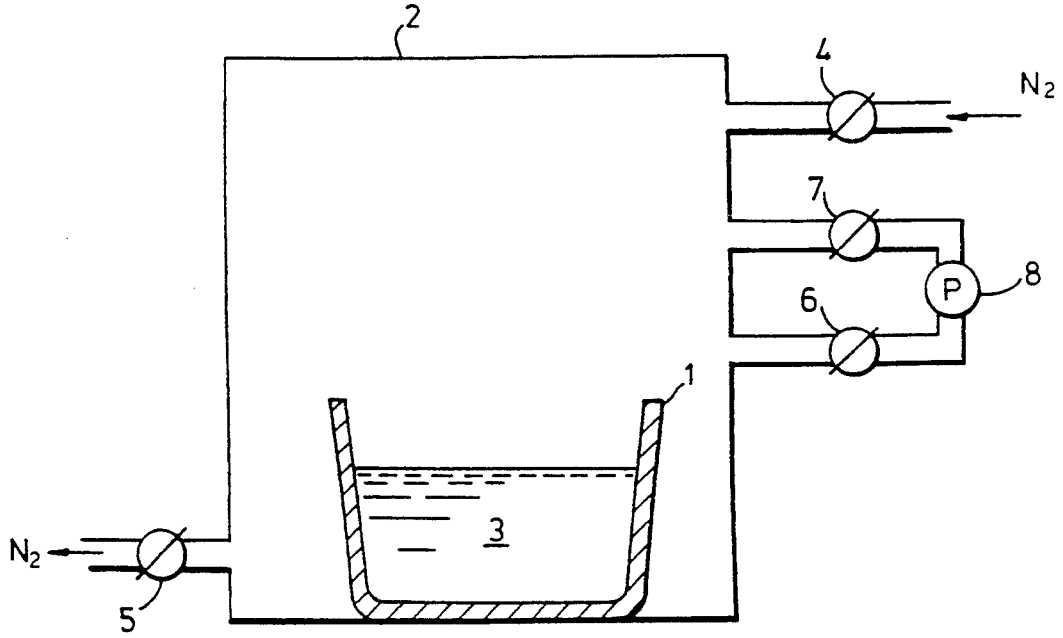
FIG. 1 is a schematic representation of a casting furnace.

Production of the ferromagnetic material by casting techniques may be seen in FIG. 1. A pyrolitic boron nitride (PBN) crucible 1 is placed within a furnace 2. The PBN crucible contains melt constituents 3 in appropriate ratios and typical purity values of 99.999%. With the PBN crucible in the furnace, valves 4 and 5 are closed, valves 6 and 7 are opened, And vacuum pump 8 pumps the furnace down to a vacuum of about $10^{-3}$ Torr. When a vacuum of this level is achieved, valves 6 and 7 are closed, the vacuum pump is stopped and valves 4 and 5 are opened. With valves 4 and 5 open, a continuous flow of high purity nitrogen gas is flushed through the furnace 2. The furnace is then heated up as quickly as possible until the melt constituents are molten. Boric oxide 9 forms an upper encapsulating layer on melting and prevents loss of volatile melt constituents.

The furnace is maintained at the elevated temperature for about 2 hours in order to facilitate substantially a fully homogeneous mixture of melt constituents. The furnace 2 is then switched off, with the PBN comacible 1 and its contents brought down to ambient temperature by .Furnace cooling in a flowing nitrogen atmosphere.

Where homogenisation of the ferromagnetic material is required the production may include an annealing process. A typical annealing program is to elevate, and maintain, the as cast material to temperature of about 800° C. for about 14 days in a vacuum of about $10^6$Torr. followed by furnace cooling.

Table 1 gives, by way of example only, specific compositions where M is gallium and N is antimony with typical saturation magnetization and $T_c$ values. It can be seen that for some compositions these values are provided for annealed samples, whilst all samples have typical melt spun values. Table 2 gives typical X-Ray diffraction data concerning lattice constants of ferromagnetic material where M is gallium and N is antimony

TABLE 1

| | $T_c$ (°C.) | | $M_s$ (emu/g) | |
|---|---|---|---|---|
| Ga/Sb | Annealed | M Spun | Annealed | M Spun |
| 10/30 | 83 | 128 | 36 | 41 |
| 20/20 | 309 | 308 | 72 | 68 |
| 22.5/17.5 | 377 | 362 | 79 | 76 |
| 25/15 | | 382 | 81 | 78.5 |
| 27.5/12.5 | 431 | 384 | 83 | 81.5 |
| 29/11 | | 389 | | 84 |
| 30/10 | | 431 | 88 | 82 |
| 32/8 | 461 | 360 | 94 | 82 |
| 33/7 | | 470 | | 85 |
| 34/6 | 472 | 463 | | 89 |
| 36/4 | | 458 | | |
| 38/2 | | 458 | | 89 |

TABLE 2

| Atomic % | | | Annealed | | | Melt Spun | | |
|---|---|---|---|---|---|---|---|---|
| Fe | Ga | Sb | a (Å) | c (Å) | at vol (Å$^3$) | a (Å) | c (Å) | at vol (Å$^3$) |
| 60 | 10 | 30 | 4.111 | 5.141 | 15.05 | 4.127 | 5.147 | 15.19 |
| 60 | 20 | 20 | 4.108 | 5.110 | 14.94 | 4.110 | 5.116 | 14.97 |
| 60 | 25 | 15 | 4.108 | 5.085 | 14.86 | 4.107 | 5.108 | 14.88 |
| 60 | 30 | 10 | 4.105 | 5.066 | 14.79 | 4.106 | 5.074 | 14.82 |
| 60 | 32 | 8 | 4.104 | 5.067 | 14.78 | 4.108 | 5.063 | 14.80 |
| 60 | 34 | 6 | | | | 4.103 | 5.051 | 14.73 |
| 60 | 36 | 4 | | | | 4.106 | 5.043 | 14.73 |
| 60 | 38 | 2 | | | | 4.114 | 5.030 | 14.75 |

We claim:

1. A ferromagnetic material having a $B8_2$ crystal structure consisting essentially of $Fe_{60}M_xN_y$ where M is at least one element selected from the group consisting of Al, Ga, In and Tl; N is at least one element selected from the group consisting of As, Sb and Bi; where x has a range of $1 \leqq x \leqq 39$; and where $x+y=40$ and wherein when M is Ga, N is not As.

2. The ferromagnetic material according to claim 2 where M is Ga and N is Sb.

3. The ferromagnetic material according to claim 2 where x has a range of $3 \leqq x \leqq 37$.

4. The ferromagnetic material according to claim 3 where x has a range of $20 \leqq x \leqq 37$.

5. The ferromagnetic material according to claim 3 where x has a range of $20 \leqq x \leqq 37$ .

6. The ferromagnetic material according to claim 4 where the material has been homogenized.

7. The ferromagnetic material according to claim 6 where homogenization has been achieved by annealing.

8. The ferromagnetic material according to claim 7 where annealing has been carried at a temperature of between 600° C. and 900° C.

9. The ferromagnetic material according to claim 6 where homogenization has been achieved by melt spinning.

10. A ferromagnetic material having a $B8_2$ crystal structure consisting essentially of $Fe_{60}M_xN_y$ where M is at least one element selected from the group consisting of Al, Ga, In and Tl; N is at least one element selected from the group consisting of As, Sb and Bi; where x has a range of $30 \leqq x \leqq 39$; and where $x+y=40$ and wherein when M is Ga, N is not As.

* * * * *